US011038290B2

(12) United States Patent
Wang et al.

(10) Patent No.: US 11,038,290 B2
(45) Date of Patent: Jun. 15, 2021

(54) CONNECTING TERMINAL AND COAXIAL CONNECTOR

(71) Applicant: Tyco Electronics (Shanghai) Co. Ltd., Shanghai (CN)

(72) Inventors: Hao Wang, Shanghai (CN); Qijun Zhao, Shanghai (CN); Jianfei Yu, Shanghai (CN); Bo Gao, Shanghai (CN); Biao Pan, Shanghai (CN); Ning Wang, Shanghai (CN); Jiefeng Zhang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/691,958

(22) Filed: Nov. 22, 2019

(65) Prior Publication Data

US 2020/0091630 A1 Mar. 19, 2020

Related U.S. Application Data

(63) Continuation of application No. PCT/EP2018/063253, filed on May 21, 2018.

(30) Foreign Application Priority Data

May 23, 2017 (CN) ..... 201720577553.2

(51) Int. Cl.
*H01R 9/05* (2006.01)
*H01B 11/18* (2006.01)

(52) U.S. Cl.
CPC ..... *H01R 9/0518* (2013.01); *H01B 11/18* (2013.01); *H01R 9/0503* (2013.01)

(58) Field of Classification Search
CPC ... H01R 9/0518; H01R 9/09503; H01B 11/18
See application file for complete search history.

(56) References Cited

U.S. PATENT DOCUMENTS 3,748,634 A * 7/1973 Barnes ..... H01R 4/4818 439/852
3,790,919 A * 2/1974 Landolt ..... H01R 4/2416 439/397

(Continued)

FOREIGN PATENT DOCUMENTS

DE 10256374 B3 7/2004
DE 102004028328 A1 3/2005

(Continued)

OTHER PUBLICATIONS

Notification, and the International Search Report and Written Opinion of the International Searching Authority, PCT/EP2018/063253, dated Sep. 3, 2018, 15 pages.

(Continued)

*Primary Examiner* — Alexander Gilman
(74) *Attorney, Agent, or Firm* — Barley Snyder

(57) ABSTRACT

A connecting terminal for a coaxial connector includes a fixing portion, an inserting portion integrally connected to a first end of the fixing portion, a cable connecting portion integrally connected to a second end of the fixing portion opposite to the first end of the fixing portion, and a stopper portion disposed inside the fixing portion. The stopper portion prevents an injection molding gel from flowing from the second end to the first end within the fixing portion.

19 Claims, 3 Drawing Sheets

(56) References Cited

U.S. PATENT DOCUMENTS

| | | | | |
|---|---|---|---|---|
| 5,445,541 | A * | 8/1995 | May | H01R 13/04 439/595 |
| 6,666,733 | B2 * | 12/2003 | Takatsuki | H01R 13/055 439/866 |
| 7,618,279 | B1 * | 11/2009 | Osborn, Jr. | H01R 4/4818 439/441 |
| 8,360,812 | B2 * | 1/2013 | Osvatic | H01R 13/055 439/819 |
| 8,366,483 | B2 * | 2/2013 | Hardy | H01R 24/40 439/585 |
| 9,667,000 | B1 * | 5/2017 | Morello | H01R 43/16 |
| 10,003,152 | B1 * | 6/2018 | Bianca | H01R 13/432 |
| 2008/0146090 | A1 * | 6/2008 | Shimizu | H01R 13/4223 439/842 |

FOREIGN PATENT DOCUMENTS

| | | | |
|---|---|---|---|
| EP | 1860734 | A1 | 11/2007 |
| JP | H1069947 | A | 3/1998 |
| WO | 2007089879 | A1 | 8/2007 |
| WO | 2014037859 | A1 | 3/2014 |

OTHER PUBLICATIONS

Abstract DE 10256374 B3, dated Jul. 15, 2004, 1 page.
Abstract DE 102004028328 Al, dated Mar. 17, 2005, 1 page.
Abstract JPH1069947 A, dated Mar. 10, 1998, 1 page.
Abstract of EP 1860734 A1, dated Nov. 28, 2007, 1 page.

* cited by examiner

CONNECTING TERMINAL AND COAXIAL CONNECTOR

CROSS-REFERENCE TO RELATED APPLICATIONS

This application is a continuation of PCT International Application No. PCT/EP2018/063253, filed on May 21, 2018, which claims priority under 35 U.S.C. § 119 to Chinese Patent Application No. 201720577553.2, filed on May 23, 2017.

FIELD OF THE INVENTION

The present invention relates to a coaxial connector and, more particularly, to a connecting terminal for a coaxial connector.

BACKGROUND

A coaxial connector for connecting a coaxial cable comprises an outer cylinder and a connecting terminal disposed at a central portion of the outer cylinder. Correspondingly, a fitting cylinder and a socket located at a center of the fitting cylinder are provided within a mating connector mated with the coaxial connector. When the coaxial connector and the mating connector are engaged with each other, the outer cylinder of the coaxial connector is connected with the mating cylinder of the mating connector, and the connecting terminal is inserted and electrically connected into the socket, thereby realizing the electrical connection between the cable and the mating connector.

SUMMARY

A connecting terminal for a coaxial connector includes a fixing portion, an inserting portion integrally connected to a first end of the fixing portion, a cable connecting portion integrally connected to a second end of the fixing portion opposite to the first end of the fixing portion, and a stopper portion disposed inside the fixing portion. The stopper portion prevents an injection molding gel from flowing from the second end to the first end within the fixing portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
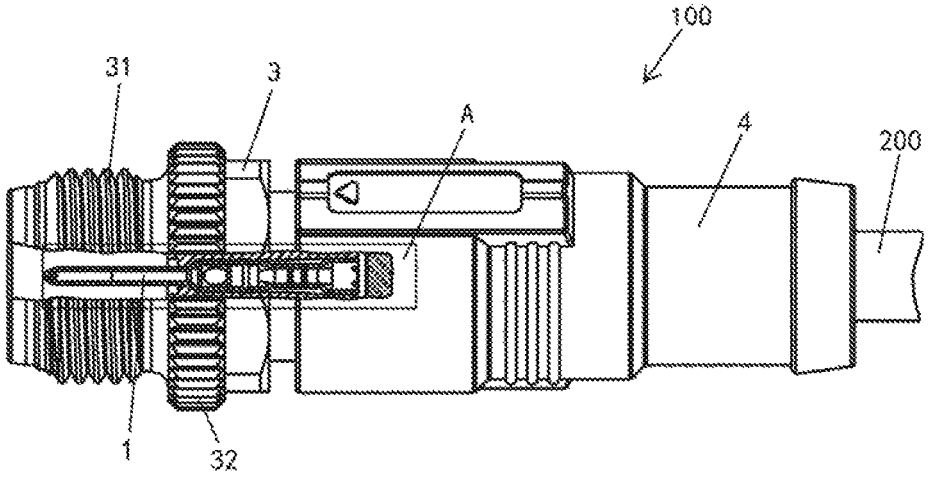
FIG. 1 is a partially sectional side view of a coaxial connector according to an embodiment.

The disclosure will be fully described with reference to the accompanying drawings containing embodiments, but it should be understood prior to this description that those skilled in the art may modify the disclosure described herein while obtaining the technical effect of the disclosure. Therefore, it should be understood that the above description is a broad disclosure for those of ordinary skill in the art, and its content is not limited to the described exemplary embodiments.

In addition, in the following detailed description, for the sake of explanation, numerous specific details are set forth in order to provide a thorough understanding of the disclosed embodiments. It will be apparent, however, one or more embodiments may also be practiced without these specific details. In other instances, well-known structures and devices are illustrated schematically in order to simplify the drawing.

Figure 2:
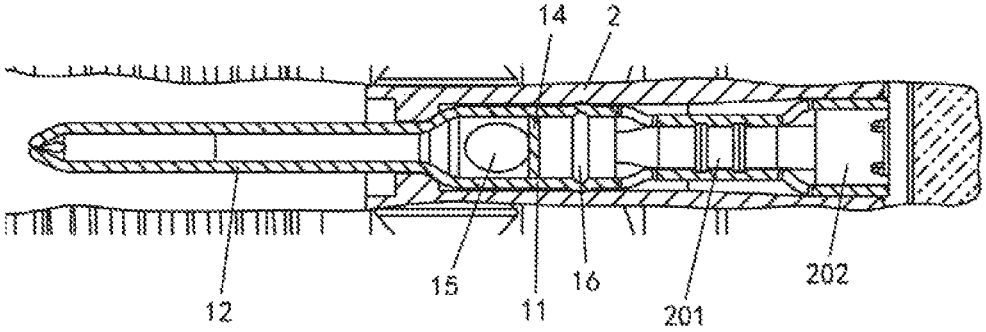
FIG. 2 is an enlarged view of a portion A of FIG. 1.

As shown in FIGS. 1 and 2, a coaxial connector 100 according to an embodiment connects with a coaxial cable 200, which includes a conductor core 201 and a protecting layer 202 wrapped around an outside of the conductor core 201. In another embodiment, the coaxial cable 200 includes a conductor core 201, a protective layer 202 wrapped around the outside of the conductor core 201, and a peripheral conductor located at a periphery of the conductor core 201 and insulated from the conductor core 201.

In the following description, if the coaxial connector 100 is a plug connector, the mating connector is a receptacle connector; and if the coaxial connector 100 is a receptacle connector, the mating connector is a plug connector. The embodiment of the disclosure will be described below using the coaxial connector 100 as a plug connector as an example.

The coaxial connector 100, as shown in FIGS. 1 and 2, includes a connecting terminal 1, an insulator 2, and an outer cylinder 3. The insulator 2 is overmolded on the connecting terminal 1, by an injection molding process, to which the cable 200 is connected, and the outer cylinder 3 is mounted on the outside of the insulator 2 so that the connecting terminal 1 and the outer cylinder 3 are electrically insulated from each other.

As shown in FIGS. 3-6, the connecting terminal 1 is made of a single piece of metal sheet, for example a copper sheet, and includes a cylindrical fixing portion 11, a cylindrical inserting portion 12 and a cable connecting portion 13. The fixing portion 11 is configured to position the connecting terminal 1 to mount the connecting terminal 1 in the outer cylinder 3. The insertion portion 12 is integrally connected to a first end of the fixing portion 11, a right end in FIGS. 5 and 6, and is configured to be inserted into a socket of the mating connector. The cable connecting portion 13 is integrally connected to a second end, a left end in FIGS. 5 and 6, of the fixing portion 1 opposite to the first end, and is configured to electrically connect with the cable 200, as shown in FIGS. 1 and 2.

Figure 4:
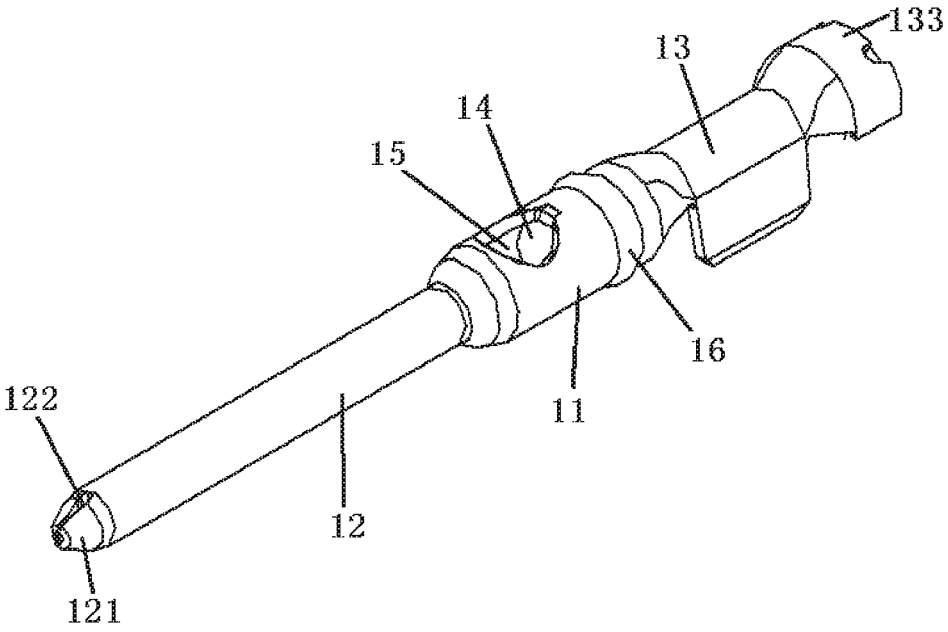
FIG. 4 is a bottom perspective view of the connecting terminal of FIG. 3.
Figure 6:
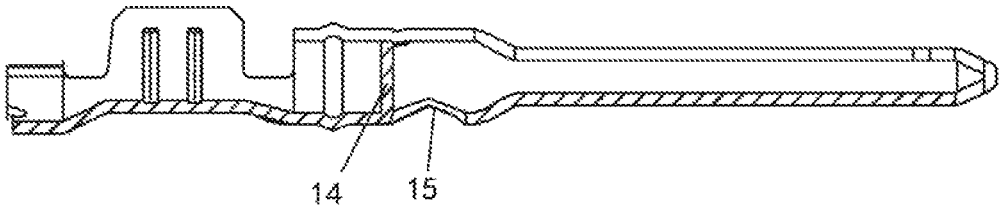
FIG. 6 is a sectional side view of the connecting terminal of FIG. 3.

As shown in FIGS. 4 and 6, a stopper portion 14 is provided inside the fixing portion 11. The stopper portion 14 is configured to prevent an injection molding gel for forming the insulator 2 from flowing from the second end to the first end and into the insertion portion 12 inside the fixing portion 11, when injecting the injection molding gel outside the fixing portion 11 and the wiring portion 13 during forming the insulator 2. In this way, poor electrical contact between the insertion portion 12 of the connecting terminal 1 and the socket of the mating connector may be avoided.

As shown in FIG. 4, an opening 15 is formed on and leads to the inside of the fixing portion 11. The stopper portion 14 is integrated with the fixing portion 11 and extends from an edge of the opening 15, adjacent to the second end, toward the inside of the fixing portion 11. In this way, the periphery of the opening 15 may be partially cut, and the cut portion of the fixing portion 11 is pressed inward so that the cut portion is inwardly bent, thereby forming the stopper portion 14.

Figure 3:
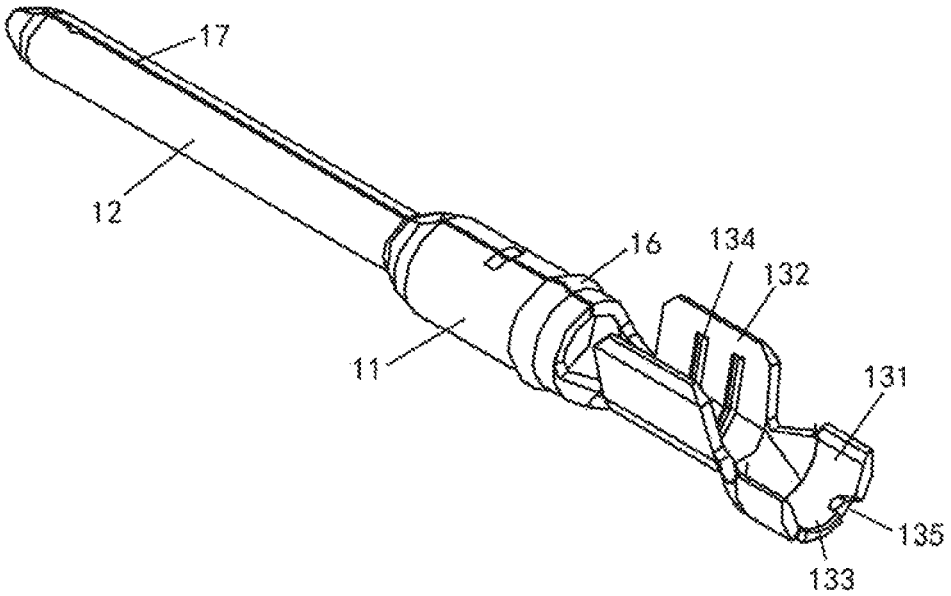
FIG. 3 is a top perspective view of a connecting terminal of the coaxial connector.
Figure 5:
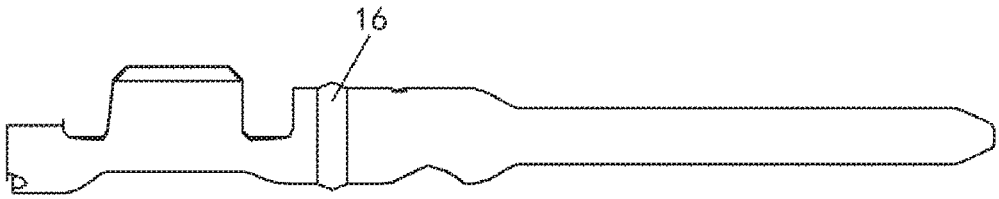
FIG. 5 is a side view of the connecting terminal of FIG. 3.

As shown in FIGS. 3-5, an annular stopper protrusion 16 is further formed on the fixing portion 11. The annular stopper protrusion 16 is located between the stopper portion 14 and the second end and protrudes radially outwardly around an outer peripheral surface of the fixed portion 11, so as to prevent the injection molding gel outside the fixing portion 11 from flowing from the second end to the first end and the outside of the inserting portion 12 when the injection molding gel is injected outside the fixing portion 11 and the cable connecting portion 13. In this way, poor electrical contact between the inserting portion 12 of the connecting terminal 1 and the socket of the mating connector may be further avoided.

Figure 7:
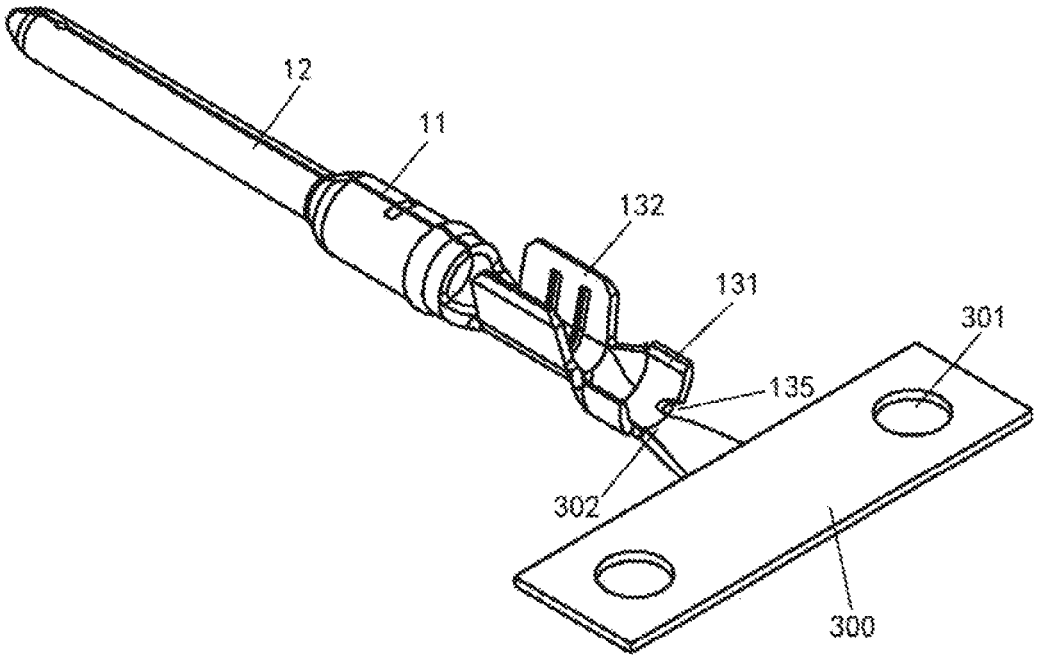
FIG. 7 is a perspective view of a state during a process of manufacturing the connecting terminal of FIG. 3.

The cable connecting portion 13 includes a first crimping portion 131 and a second crimping portion 132, as shown in FIGS. 3 and 7. The first crimping portion 131 is configured to be crimped onto a portion of the protective layer 202 of the cable 200 so as to mechanically fix the cable 200. The second crimping portion 132 is disposed between the second end of the fixing portion 11 and the first crimping portion 131, and configured to be crimped onto an exposed conductor core 201 of the cable 200 so that the connecting terminal 1 is electrically connected to the cable 200. An inwardly projecting rib 134 is provided inside the second crimping portion 132 to maintain good electrical contact between the second crimping portion 132 and the conductor core 201.

In the embodiment shown in FIGS. 3-6, the first crimping portion 131 and the second crimping portion 132 both have substantially U-shaped cross-sections. In this way, when the protective layer 202 and the conductor core 201 of the cable 200 are crimped by the first crimping portion 131 and the second crimping portion 132, respectively, the first crimping portion 131 and the second crimping portion 132 may be controlled to keep a consistent concentricity with respect to the inserting portion 11, avoiding deviation of the first crimping portion 131 and the second crimping portion 132 with respect to an axis of the inserting portion 11.

FIG. 7 shows a state during a process of manufacturing the connecting terminal 1. As shown in FIG. 7, the connecting terminal 1 is formed by using a single piece of copper sheet through mechanical processes, such as shearing, stamping, bending, etc., when making the connecting terminal 1. It is necessary to retain a supporting portion 300 on the processed copper sheet in advance and form a fixing hole 301 on the supporting portion 300 so as to facilitate the operation. The copper piece is fixed to an operating frame by bolts passing through the fixing holes 301 so that the copper piece is machined.

As shown in FIGS. 3-7, an outer edge of the first crimping portion 131 has a cut portion 133. The cut portion 133 is configured to be connected to the support portion 300 for supporting the connecting terminal 1 during a process of manufacturing the connecting terminal 1. An indentation 302 is formed between the cut portion 133 and the supporting portion 300, so that after the process of machining the connecting terminal 1 is completed, the supporting portion 300 may be bent at the indentation 302 to remove the supporting portion 300 from the connecting terminal 1, forming the final connecting terminal 1.

In a process of assembling the coaxial connector 100, the protective layer of the cable 200 is first stripped and removed to expose a portion of the conductor core 201. Then, the conductor core 201 and a part of the protective layer 202 are respectively placed on the U-shaped structures of the second crimping portion 132 and the first crimping portion 131. The second crimping portion 132 and the first crimping portion 131 are then clamped by crimping tools, such as clamps, to fix the conductor core 201 and the portion of the protective layer 202 into the second crimping portion 132 and the first crimping portion 131, respectively. The injection molding gel is then applied on the first and second crimping portions 131, 132 of the connecting terminal 1 through an injection molding process. After the injection molding gel is solidified, the insulator 2 is coated around the outside of the second crimping portion 132 and the first crimping portion 131.

As shown in FIGS. 3 and 7, a plurality of notches 135 recessed inwardly from the outer edge of the first crimping portion 131 are provided on two opposite sides of the cut portion 133. A length of the cut portion 133 in the axial direction of the connecting terminal 1 does not exceed the outer edge of the first crimping portion 131. That is, the cut portion 133 is not beyond than, and in an embodiment is under, a plane defined by the outer edge of the first crimping portion 131. In this way, in the process of mounting the connecting terminal 1 coated with the insulator 2 into the outer cylinder 3 by pushing the outer edge of the first crimping portion 131, the cut portion 133 does not hinder but facilitates a movement of the connecting terminal 1, allowing the connecting terminal 1 to be accurately positioned in the outer cylinder 3.

An inserting end 121 of the inserting portion 12 has a truncated cone shape tapering toward a tip of the inserting end 121, as shown in FIG. 4. The inserting end 121 has a radially continuous cutout 122 which extends radially through the inserting end 121. In this way, the inserting portion 12 may be easily engaged with the socket of the mating connector.

In an embodiment shown in FIG. 3, the fixing portion 11 and the inserting portion 12 both have seams 17 extending in an axial direction of the connecting terminal 1. An internal space of the fixing portion 11 is in communication with an internal space of the inserting portion 12. The seams 17 are formed during the process of forming the fixing portion 11 and the inserting portion 12 by crimping or curling, so that the inserting portion 12 may be radially expanded and contracted, which increases the engagement strength of the connecting terminal 1 with the mating connector. An outer diameter of the inserting portion 12 is smaller than an outer diameter of the fixing portion 11.

As shown in FIGS. 1 and 2, in the coaxial connector 100, the insulator 2 is overmolded on at least one of the fixing portion 11 and the crimping portion 12. The inserting portion 12 of the connecting terminal 1 is at least partially suspended within the outer cylinder 3 such that the inserting portion 12 is electrically connected to the socket of the mating connector, forming an electrical connection with the coaxial cable 200.

As shown in FIG. 1, the coaxial connector 100 includes a housing 4 rotatably mounted on the outer cylinder 3. The cable 200 passes through the housing 4 in the axial direction and connects to the connecting terminal 1. A threaded portion 31 and a grooved operation portion 32 are provided on the outer cylindrical 3, and the outer cylindrical 3 may be rotated by hand holding the grooved operating portion 32 so that the coaxial connector 100 and a threaded portion of the mating connector are engaged by screw thread while the inserting portion 12 is inserted into the socket of the mating connector.

In an embodiment, the outer cylinder 3 is electrically conductive, the cable 200 includes a peripheral conductor disposed on the periphery of the conductor core 201, and the peripheral conductor is electrically connected to the outer cylinder 3 on the outside of the insulator 2. In this way, while the coaxial connector 100 is threadedly engaged with the threaded portion of the mating connector, and the inserting portion 12 of the coaxial connector 100 is inserted into the socket of the mating connector, the outer cylinder 3 of the coaxial connector 100 is electrically connected to the mating cylinder of the mating connector.

Those skilled in the art may understand that the above-described embodiments are all exemplary, and the structures described in the various embodiments may be combined freely without any subject to conflict in structures or principles, so as to realize more kinds of connecting terminals and coaxial connectors on the basis of solving the technical problems of the disclosure.

After a detailed description of the preferred embodiments of the disclosure, those skilled in the art may clearly understand that various changes and modifications may be made without departing from the scope and spirit of the appended claims, and the disclosure is not limited to the implementations of the exemplary embodiments described in the specification.

What is claimed is:

1. A connecting terminal for a coaxial connector, comprising:

a fixing portion having an opening extending to an inside thereof;

an inserting portion integrally connected to a first end of the fixing portion;

a cable connecting portion integrally connected to a second end of the fixing portion opposite to the first end of the fixing portion; and a stopper portion disposed inside the fixing portion and preventing an injection molding gel from flowing from the second end to the first end within the fixing portion, the stopper portion being integral with the fixing portion and extending from an edge of the opening adjacent to the second end and toward the inside of the fixing portion, a peripheral edge of the stopping portion disposed inside of the fixing portion and abutting an opposing interior wall of the fixing portion.

2. The connecting terminal of claim 1, wherein the fixing portion is configured to position the connecting terminal, the inserting portion is configured to be inserted into a socket of a mating connector, and the cable connecting portion is electrically connected with a cable.

3. The connecting terminal of claim 1, wherein the fixing portion has a cylindrical shape, and wherein the stopper portion comprises a generally radial outer periphery for engaging with a corresponding radial inner sidewall of the interior wall of the fixing portion.

4. The connecting terminal of claim 3, wherein the opening comprises a generally elliptical shape.

5. The connecting terminal of claim 1, wherein the fixing portion has a stopper protrusion with an annular shape, the stopper protrusion disposed between the stopper portion and the second end of the fixing portion.

6. The connecting terminal of claim 5, wherein the stopper protrusion protrudes radially outwardly around an outer peripheral surface of the fixing portion and prevents the injection molding gel from flowing outside the fixing portion from the second end to the first end.

7. The connecting terminal of claim 6, wherein the cable connecting portion has a first crimping portion configured to be crimped onto a portion of a protective layer of a cable so as to mechanically fix the cable, and a second crimping portion disposed between the second end of the fixing portion and the first crimping portion and configured to be crimped onto an exposed conductor core of the cable.

8. The connecting terminal of claim 7, wherein an outer edge of the first crimping portion has a cut portion, the cut portion is connected to a support portion for supporting the connecting terminal during a process of manufacturing the connecting terminal.

9. The connecting terminal of claim 8, wherein the first crimping portion has a plurality of notches recessed inwardly from the outer edge of the first crimping portion on opposite sides of the cut portion.

10. The connecting terminal of claim 9, wherein a length of the cut portion in an axial direction of the connecting terminal does not extend beyond the outer edge of the first crimping portion.

11. The connecting terminal of claim 1, wherein the inserting portion has an inserting end with a truncated cone shape tapering toward a tip of the inserting end.

12. The connecting terminal of claim 11, wherein the inserting end has a cutout extending radially through the inserting end.

13. The connecting terminal of claim 1, wherein the fixing portion and the inserting portion each have a seam extending in an axial direction of the connecting terminal.

14. The connecting terminal of claim 13, wherein an internal space of the fixing portion communicates with an internal space of the inserting portion.

15. A coaxial connector, comprising:

a connecting terminal including a cylindrical fixing portion having an opening extending through an outer wall thereof, an inserting portion integrally connected to a first end of the fixing portion, a cable connecting portion integrally connected to a second end of the fixing portion opposite to the first end of the fixing portion, and a stopper portion disposed inside the fixing portion and abutting an inner side of the outer wall of the fixing portion about its periphery for preventing an injection molding gel from flowing from the second end to the first end within the fixing portion, the stopper portion being integral with the fixing portion and extending from an edge of the opening adjacent to the second end toward the inside of the fixing portion;

an insulator molded on at least one of the fixing portion and the cable connecting portion; and an outer cylinder mounted radially outside the insulator, the inserting portion of the connecting terminal is at least partially suspended within the outer cylinder such that the inserting portion is electrically connected to a socket of a mating connector.

16. The coaxial connector of claim 15, further comprising a housing rotatably mounted on the outer cylinder, a cable passing through the housing in an axial direction and connected to the connecting terminal.

17. The coaxial connector of claim 15, wherein the outer cylinder is electrically conductive and a cable has a peripheral conductor disposed at a periphery of a conductor core of the cable, the peripheral conductor is disposed outside the insulator and is electrically connected to the outer cylinder.

18. A connecting terminal for a coaxial connector, comprising:

a fixing portion having an opening through an outer sidewall thereof;

an inserting portion integrally connected to a first end of the fixing portion;

a cable connecting portion integrally connected to a second end of the fixing portion opposite to the first end of the fixing portion; and a stopper portion integral with the fixing portion and disposed inside the fixing portion, a peripheral edge of the stopping portion abutting an opposing interior wall of the fixing portion for preventing fluid communication inside of the fixing portion between the first end and the second end.

19. The connecting terminal of claim 18, wherein the fixing portion is cylindrical and the opening comprises an elliptical opening, the stopper portion corresponding in shape to the opening and extending from an edge of the opening in a direction perpendicular to an axial direction of the fixing portion.

* * * * *